United States Patent [19]

Chao-Chin et al.

[11] Patent Number: 5,019,009

[45] Date of Patent: May 28, 1991

[54] TOY CAR CHASSIS INTERMITTENT TILT AND STEERING STRUCTURE

[75] Inventors: Lin Chao-Chin; Tseng Kuo-Heng, both of Taippei, Taiwan

[73] Assignee: Regency, Inc., New York, N.Y.

[21] Appl. No.: 491,480

[22] Filed: Mar. 12, 1990

[51] Int. Cl.[5] ..... A63H 17/00

[52] U.S. Cl. ..... 446/437; 446/460

[58] Field of Search ..... 446/437, 436, 456, 462, 446/466, 460

[56] References Cited

U.S. PATENT DOCUMENTS

| | | | |
|---|---|---|---|
| 2,247,354 | 7/1941 | Berger | 446/437 |
| 4,846,758 | 7/1989 | Chou | 446/437 |
| 4,850,931 | 7/1989 | Auer | 446/437 |
| 4,892,503 | 1/1990 | Kumazawa | 446/437 X |

FOREIGN PATENT DOCUMENTS

| | | | |
|---|---|---|---|
| 938835 | 2/1956 | Fed. Rep. of Germany | 446/437 |
| 641563 | 8/1950 | United Kingdom | 446/437 |

*Primary Examiner*—Mickey Yu

*Attorney, Agent, or Firm*—Howard F. Mandelbaum

[57] ABSTRACT

An automatic tilting toy car has a lift wheel lever extending from the underside of the car chassis for periodically raising one side of the chassis as a motor drives the car thereby giving the appearance that the car travelling on one front and one back wheel on the same side of the chassis and enabling the car to automatically turn away from a motion impeding obstacle to resume movement without operator intervention.

11 Claims, 3 Drawing Sheets

TOY CAR CHASSIS INTERMITTENT TILT AND STEERING STRUCTURE

BACKGROUND OF THE INVENTION

This invention relates to battery driven toy cars. More specifically, this invention relates to a battery driven toy car for which obstacles in the path of the toy car can bring it to a halt, requiring the intervention of the operator to physically move the toy car or the obstacle in order to enable the toy car to resume its desired motion.

It is known in the prior art to equip a toy car with a battery driven motor to propel the toy car. It is further known to equip the toy car with a switch to energize the motor which is operationally connected to the driving wheels of the toy car.

Some toy cars can only run in a straight forward direction. When they encounter an obstacle, they can no longer move. Remotely controlled cars which can be shifted into reverse or steered away from an obstacle, before or after collision, cannot be operated by very young children. Moreover, they are expensive and complex, requiring electrical or electronic controls boxes and either long wires or radio transmitters and receivers. None of these prior art toy cars can run in a tilted disposition to simulate a feat sometimes performed by highly skilled stunt drivers in real cars.

In use, a child operating a toy car places the switch in its on position while holding the toy car off the surface on which it is intended to travel and then places the toy car on the travel surface, pointed in the intended direction of travel. Unless the toy car is operated in a large open area, it is likely to quickly collide with an obstacle such as a wall, piece of furniture, or any other stationary object of sufficient mass that is standing on the travel surface. More often than not, such collisions bring the toy car to a complete halt.

If motion of the toy car is to be resumed, it must be lifted and turned in a direction away from the obstacle before being replaced on the travel surface for continued motion. This shortcoming severely limits the distance that the toy car can travel without intervention by the operator who is customarily a child, results in frustration, and otherwise decreases the degree of enjoyment of the toy. Moreover, long runs in parallel disposition on a level travel surface can be boring to a child whose interest may be excited by having the car assume a tilted position while it is traveling.

SUMMARY OF THE INVENTION

The foregoing problems of prior art battery driven toy cars are overcome by the instant invention which teaches the structure of a vehicle, adapted for movement on a travel surface, having a chassis, a propulsion system mounted on the chassis, at least one driven wheel rotatably mounted on the chassis and operatively connected to the propulsion system for propelling the vehicle while in engagement with the travel surface, at least two other wheels in addition to the one driven wheel rotatably mounted on the chassis for normally supporting the vehicle in parallel disposition to the travel surface when the vehicle is in motion, the lowermost surfaces of the driven and other wheels defining a plane, a lifting member including a lever pivotally mounted on the chassis and an auxiliary lift wheel mounted adjacent one end of the lever for movement relative to the chassis between a first position on the side of the plane proximate the chassis and a second position on the side of the plane distal from the chassis, and an actuating device, preferably powered by the propulsion system, operatively connected to the lifting member for effecting movement thereof between the first and second positions, a first cam including a disc and a rod mounted on the disc, the rod having a first cam surface, the disc with the rod thereon driven by the propulsion system, and the lifting member having a second cam surface slidably engageable with the first cam surface for effecting movement of the lifting member between the first and second positions.

It is therefore an object of the invention to provide a vehicle adapted for movement on a travel surface in a tilted disposition.

An additional object of the invention is to provide a vehicle adapted for movement on a travel surface in which motion is automatically restored after collision with an obstacle.

Another object of the invention is to provide a vehicle adapted for movement on a travel surface in which at least one supporting wheel is raised from the travel surface after collision with an obstacle.

Still another object of the invention is to provide a vehicle adapted for movement on a travel surface in which a driven wheel continues to propel the vehicle while at least one supporting wheel is raised from the travel surface after collision with an obstacle.

A further object of the invention is to provide a vehicle adapted for movement on a travel surface wherein a raised wheel is lowered to the travel surface travel surface after collision with an obstacle to restore motion of the vehicle.

Still a further object of the invention is to provide a vehicle adapted for movement on a travel surface wherein the propulsion system for the vehicle also raises and lowers the vehicle between parallel and tilted dispositions.

DESCRIPTION OF THE PREFERRED EMBODIMENT

Figure 1:
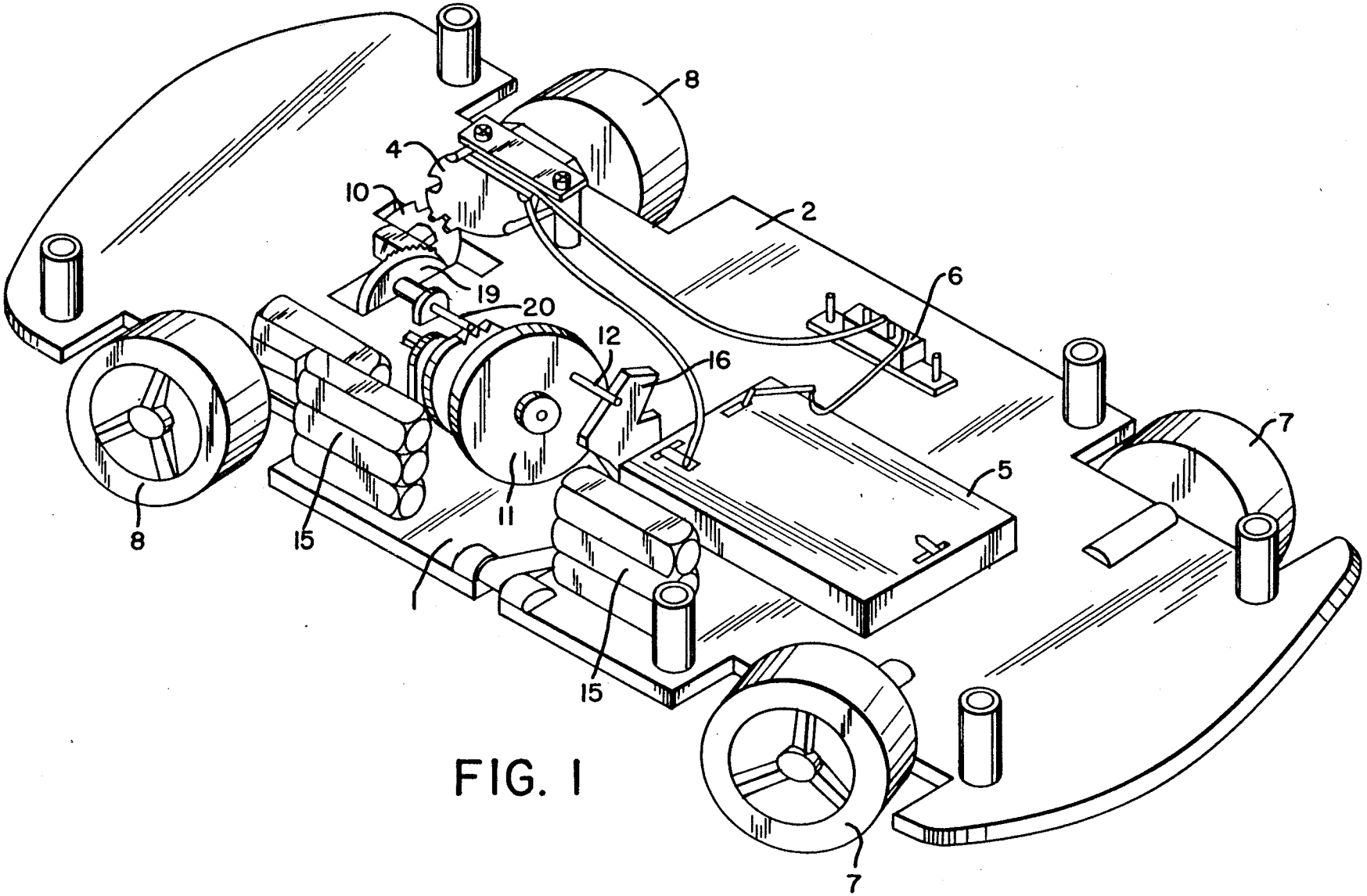
FIG. 1 is a perspective view of the preferred embodiment of the invention.
Figure 2:
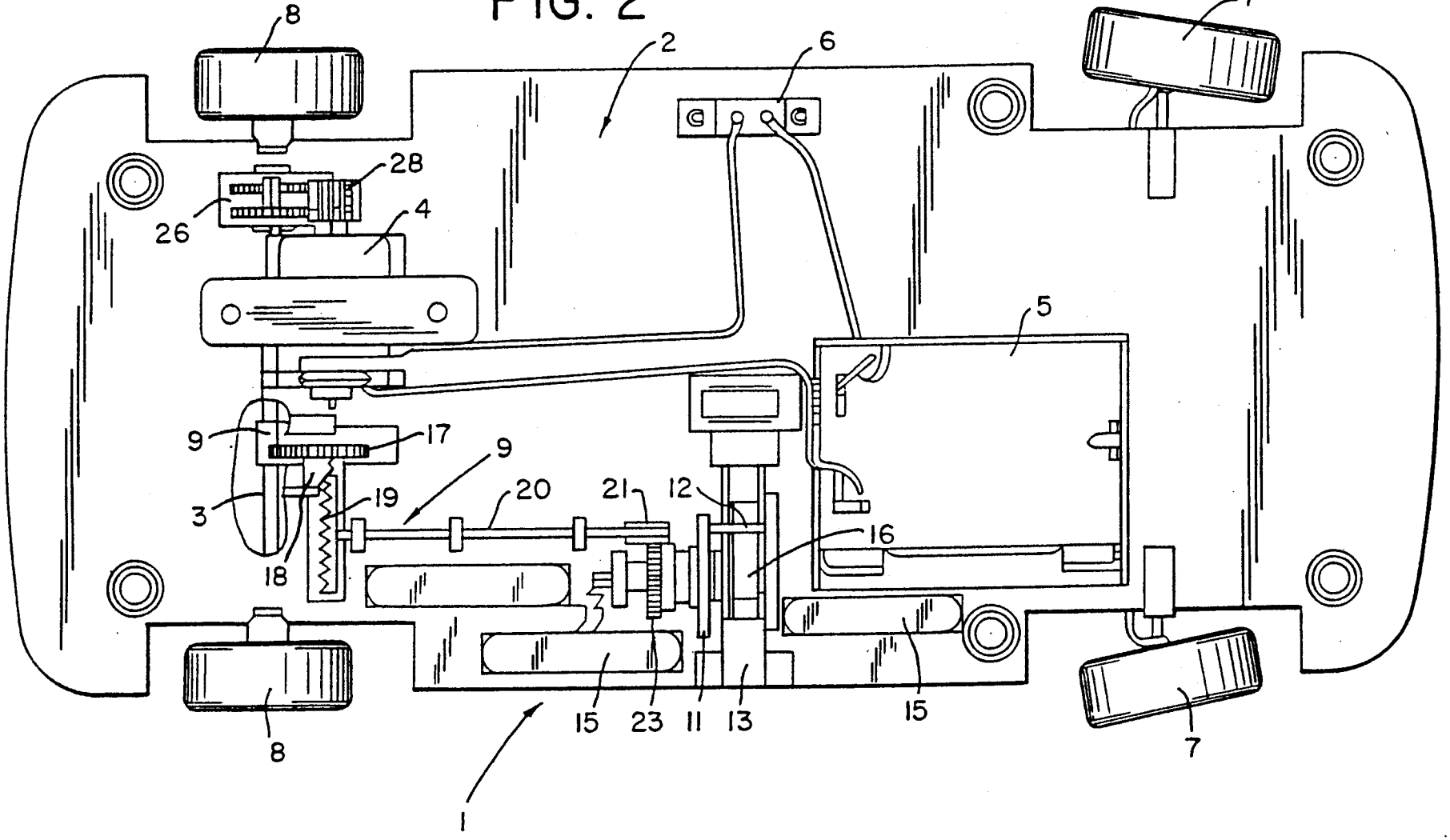
FIG. 2 is a plan view of the preferred embodiment of the invention.

Referring now to FIGS. 1 and 2 of the drawings there is shown a toy car chassis 2 with front wheels 7 and rear wheels 8. Rear wheels 8 are conventionally rotatably mounted adjacent either end of a rear axle 3.

At one end of rear axle 3 there is fixedly mounted a driven gear 26 which is engaged by a driving gear 28 that is fixedly mounted on the rotatable shaft of a battery driven electric motor 4. Power for the battery driven electric motor 4 is provided by batteries stored in a battery compartment 5 mounted on the toy car chassis 2. A conventional on-off switch 6 is used to turn the battery driven electric motor 4 on and off to selectively impart a rotational torque to the rear axle 3.

A drive gear 9 is centrally fixedly mounted on rear axle 3 for rotation therewith. Mounted in engagement with the rear axle centrally mounted drive gear 9 is a set of speed reducing gears 10. The first speed reducing gear of the set 10 is a dual gear having a base 17 with a substantially larger diameter than the rear axle centrally mounted drive gear 9 and correspondingly more teeth which engage the teeth of the rear axle centrally mounted drive gear 9. Coaxially fixedly mounted on the base portion 17 of the first speed reducing gear is a pinion 18 of much smaller diameter than the base gear 17 and having correspondingly fewer teeth.

A drive shaft 20 is also rotatably mounted on the toy car chassis 2, with its axis orthogonal to the axis of the rear axle 3. At one end of the drive shaft 20, adjacent the rear axle 3, there is fixedly mounted a second speed reducing gear 19, in the form of a crown gear, in engagement with the pinion portion of the first speed reducing gear 17. The second speed reducing gear 19 is substantially larger than the pinion portion of the first speed reducing gear 17 which drives it so that the rotational speed of the drive shaft 20 is substantially less than the rotational speed of the first speed reducing gear 17 which is in turn substantially less than the rotational speed of the rear axle 3.

Fixed to the end of the drive shaft 20 is a driving pinion 21 which engages a third speed reducing gear 23 coaxially fixedly mounted with an axially displaced lever actuating disc 11. The third speed reducing gear 23 is substantially larger than the pinion 21 which drives it so that the rotational speed of the third speed reducing gear 23 and lever actuating disc 11 is substantially less than the rotational speed of the driving gear 21. The result is that the lever actuating disc 11 turns much more slowly than the battery driven electric motor 4 and the rear wheels 8.

Extending orthogonally from the planar surface of the lever actuating disc 11 opposite the driving gear 21 is an eccentrically mounted cylindrical rod 12. As the lever actuating disc 11, which serves as an actuating device for the lift wheel lever 13, rotates driven by the propulsion system including the battery driven electric motor 4 and speed reducing gears 10, the cylindrical surface of the rod 12 acts as a first cam surface as it periodically engages a second cam surface on a lift wheel lever cam 16.

The lift wheel lever cam 16 is fixedly mounted on, and extends upward from a lift wheel lever 13. Together the lift wheel lever cam 16 and lift wheel lever 13 form a lifting member. One end of the lift wheel lever 13 is pivotally mounted to the chassis 2 by a hinge pin 24 so that the lift wheel lever 13 can pivot upwardly and downwardly. Rotatably mounted on the other end of the lift wheel lever 13 for rotation in a plane parallel to the longitudinal axis of the chassis 2 is an auxiliary or lift wheel 14 for engaging the travel surface.

As the first cam surface of the drive rod 12 engages the second cam surface of the lift wheel lever cam 16, the lift wheel lever 13 swings downwardly about pivot hinge pin 24, thereby urging the lift wheel 14 against the surface on which the toy vehicle is traveling. Since the lift wheel 14 cannot move beyond the travel surface, the chassis 2 is lifted as the drive rod 12 rides down the second cam surface of lift wheel lever cam 16. This is best visualized with reference to FIGS. 3 A, B and C.

Figure 3A:
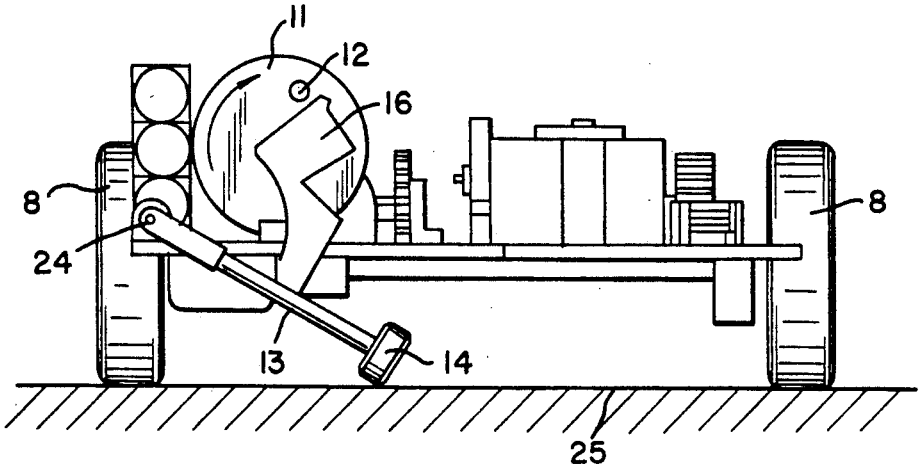
FIG. 3A is an elevation view of the preferred embodiment of the invention during a first stage of operation.
Figure 3B:
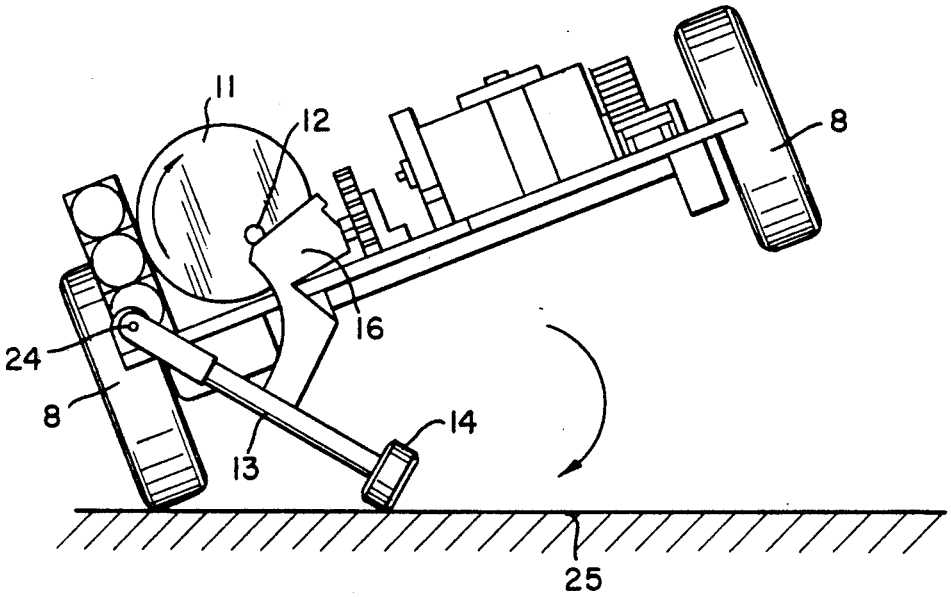
FIG. 3B is an elevation view of the preferred embodiment of the invention during a second stage of operation.
Figure 3C:
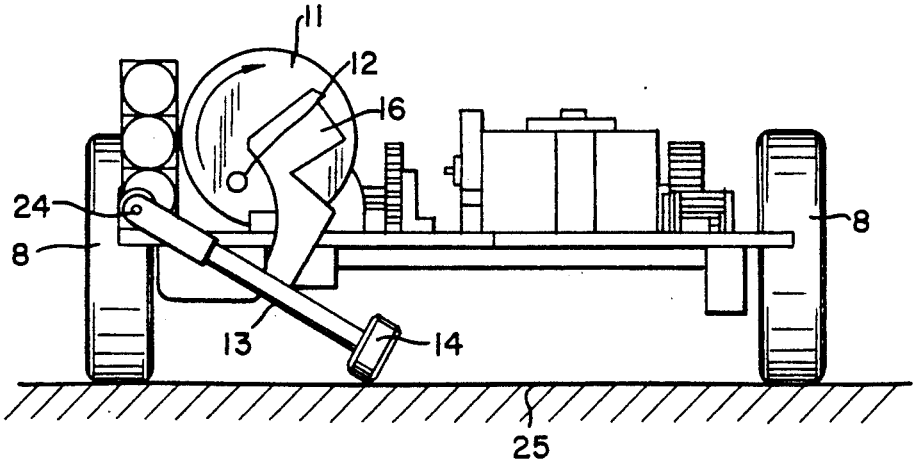
FIG. 3C is an elevation view of the preferred embodiment of the invention during a third stage of operation.

In FIG. 3A, the chassis 2 is in parallel disposition with the travel surface, with wheels 7 and 8 thereon as the rotating lever actuating disc 11 causes drive rod 12 to approach lift wheel lever cam 16 The lift wheel 14 rests on the travel surface above the plane intersecting the lowermost surfaces of the wheels 7 and 8. When drive rod 12 engages lift wheel lever cam 16, the chassis 2 is elevated and elevation continues as the first cam surface on drive rod 12 rides down the second cam surface on lift wheel lever cam 16 as seen in FIG. 3B. The lift wheel 14 then passes below the plane intersecting the lowermost surfaces of the wheels 7 and 8. As the drive rod 12 moves beyond the second cam surface on the lift wheel lever cam 16, the lifting force between the chassis 2 and lift wheel lever 13 is alleviated and the vehicle is restored to its parallel disposition by gravity as seen in FIG. 3C. This cycle wherein the actuating device including lever actuating disc 11 and drive rod 12 moves the lift wheel lever cam 16 and lift wheel lever 13 back and forth, against and with gravity, continues as the long as the battery driven electric motor 4 is powered and the vehicle is on the travel surface.

The length of the lift wheel lever 13 is preferably selected so that the lift wheel 14 engages the travel surface at a point in approximate longitudinal axial alignment with the center of gravity of the vehicle. The location of the center of gravity can be fixed by mounting an appropriately selected counterbalance weight 15 on the chassis 2. Since the vehicle is not likely to remain perfectly balanced about the lift wheel 14, one side or the other will be raised, while the remaining side stays lowered.

The result is that the front wheel 7 and rear wheel 8 on one side of the vehicle will remain on the travel surface while the other front wheel 7 and rear wheel 8 are raised off of the travel surface, enabling the vehicle to appear to run on two wheels although actually additionally supported by a third wheel, i.e., the lift wheel 14. This simulates an effect sometimes performed by stunt drivers.

Another advantage of the intermittent tilt and steering structure described above comes into play when the vehicle engages an obstacle on the travel surface which impedes its continued motion in the direction of travel. The elevation of the chassis which occurs when the drive rod 12 engages the lift wheel lever cam 16, thereby lifting two wheels off the travel surface, enables the vehicle to be turned by the driven wheel 8, remaining in engagement with the travel surface, into a new direction away from the obstacle. The vehicle then can continue to travel without intervention by the operator.

It is to be appreciated that the foregoing is a description of a preferred embodiment of the invention to which variations and modifications may be made without departing from the spirit and scope of the invention. For example, the lever actuating disc 11 and drive rod 12 can be replaced by an eccentric cam having a peripheral cam surface adapted to engage a cam surface on the lift wheel lever cam 16. Different gearing down arrangements between the motor and actuating device than the one herein described, possibly including one or more drive belts, may be employed as will be known to those skilled in the art from the teachings of the invention Also, the actuating device for moving the lift wheel lever 13 may be energized by a power plant separate and apart from the propulsion system used to drive the vehicle.

What is claimed is:

1. A vehicle adapted for movement on a travel surface comprising a chassis;

a propulsion system mounted on said chassis;

at least one driven wheel rotatably mounted on said chassis and operatively connected to said propulsion system for propelling said vehicle while in engagement with said travel surface;

at least two other wheels, in addition to said one driven wheel, rotatably mounted on said chassis for normally supporting said vehicle in parallel disposition with respect to said travel surface when said vehicle is in motion, the lowermost surfaces of said driven and other wheels defining a plane;

a lifting member movably mounted on said vehicle for movement relative to said chassis between a first position on the side of said plane proximate said vehicle chassis and a second position on the side of said plane distal from said chassis;

a lifting wheel mounted adjacent one end of said lifting member in a plane of rotation parallel to the longitudinal axis of said vehicle for engaging said travel surface and at a point in approximate longitudinal axial alignment with the center of gravity of said vehicle at least when said lifting member is in said second position; and an actuating device mounted on said chassis and operatively connected to said lifting member for effecting movement thereof between said first and second positions.

2. A vehicle adapted for movement on a travel surface according to claim 1 wherein said driven wheel is mounted on an axle and said actuating device is operatively connected to said axle for being driven thereby.

3. A vehicle adapted for movement on a travel surface according to claim 2 wherein said actuating device comprises a first cam having a first cam surface and said lifting member comprises a second cam surface slidably engageable with said first cam surface for effecting movement of said lifting member between said first and second positions.

4. A vehicle adapted for movement on a travel surface according to claim 3 wherein said first cam comprises a disc and a rod mounted on said disc, said rod comprising said first cam surface.

5. A vehicle adapted for movement on a travel surface according to claim 3 wherein said lifting member comprises a lever pivotally mounted on said chassis.

6. A vehicle adapted for movement on a travel surface in alternating parallel and tilted disposition comprising a chassis;

a motor mounted on said chassis;

a cam rotatably mounted on said chassis, said cam having a first cam surface;

torque transmitting means connected between said cam and said motor for effecting rotation of said cam in response to the torque of said motor;

a lifting member movably mounted on said chassis and having a second cam surface periodically in engagement with and movable with respect to said first cam surface; and travel surface engaging means connected to said lifting member, for rotation in a plane parallel to the longitudinal axis of said vehicle, said travel surface engaging means being urged against said travel surface at a point in approximate longitudinal axial alignment with the center of gravity of said vehicle, for lifting said chassis at least partially from said travel surface at least part of the time that said first and second cam surfaces movably engage whereby said vehicle moves in tilted disposition, and for allowing said vehicle to return to parallel disposition with respect to said travel surface when said first and second cam surfaces are disengaged.

7. A vehicle adapted for movement on a travel surface in alternating parallel and tilted disposition according to claim 6 wherein said lifting member comprises a lever pivotally mounted on said chassis.

8. A vehicle adapted for movement on a travel surface in alternating parallel and tilted disposition according to claim 6 wherein said torque transmitting means comprises a set of interconnected speed reducing gears.

9. A vehicle adapted for movement on a travel surface in alternating parallel and tilted disposition according to claim 6 wherein said cam comprises a disc having an eccentrically mounted extended rod bearing said first cam surface.

10. A method of alternately tilting and restoring the disposition of the chassis of a toy car movable on wheels with respect to a travel surface comprising movably mounting on said chassis a lifting member, including a lifting wheel mounted adjacent one end of said lifting member for rotation in a plane parallel to the longitudinal axis of said car for engaging said travel surface and at a point in approximate longitudinal axial alignment with the center of gravity of said car, movable between a first position above the plane intersecting the lowermost surfaces of said wheels in which the car is in parallel disposition with respect to said travel surface and a second position below said plane in which the car is in tilted disposition with respect to said travel surface; and alternately moving said lifting member between said first and second positions while said toy car is traveling.

11. A method of alternately tilting and restoring the disposition of the chassis of a toy car movable on wheels with respect to the surface on which it is traveling according to claim 10 further comprising using a motor driven axle to drive said car wheels and to move said lifting member.

* * * * *